US007448405B2

(12) United States Patent
Shores

(10) Patent No.: US 7,448,405 B2
(45) Date of Patent: Nov. 11, 2008

(54) MULTIPLE VALVE DRAIN AND PIPE-CLEANING DEVICE

(76) Inventor: Jerome P. Shores, 6316 S. Lakeshore Dr., Shreveport, LA (US) 71119

( * ) Notice: Subject to any disclaimer, the term of this patent is extended or adjusted under 35 U.S.C. 154(b) by 393 days.

(21) Appl. No.: 11/110,569

(22) Filed: Apr. 21, 2005

(65) Prior Publication Data

US 2005/0274415 A1 Dec. 15, 2005

Related U.S. Application Data

(60) Provisional application No. 60/578,921, filed on Jun. 14, 2004.

(51) Int. Cl.
*E03C 1/12* (2006.01)

(52) U.S. Cl. ..... 137/240; 137/606; 4/255.06; 4/696

(58) Field of Classification Search ..... 137/312, 137/606, 112, 240; 4/255.06, 255.04
See application file for complete search history.

(56) References Cited

U.S. PATENT DOCUMENTS

| | | | | | |
|---|---|---|---|---|---|
| 1,885,977 | A | * | 11/1932 | Denison | 137/240 |
| 1,938,064 | A | * | 12/1933 | Carmine | 137/240 |
| 3,936,892 | A | * | 2/1976 | Miller | 4/255.01 |
| 3,959,828 | A | | 6/1976 | Acevedo | 4/57 P |
| 3,990,855 | A | | 11/1976 | Cort et al. | 23/267 E |
| 4,141,090 | A | | 2/1979 | Rowan | 4/256 |
| 4,173,044 | A | | 11/1979 | Ota | 4/325 |
| 4,339,832 | A | | 7/1982 | Cuschera | 4/287 |
| 4,487,690 | A | | 12/1984 | Logsdon | 210/63 |
| 4,760,614 | A | * | 8/1988 | Harrison | 4/255.06 |
| 5,085,244 | A | * | 2/1992 | Funk | 137/240 |
| 5,265,282 | A | | 11/1993 | Schmucki | 4/325 |
| 5,279,319 | A | * | 1/1994 | Fidelman | 137/14 |
| 5,349,981 | A | | 9/1994 | Schmucki et al. | 137/436 |
| D369,647 | S | | 5/1996 | Dea et al. | D23/207 |
| 5,554,285 | A | | 9/1996 | Bellefeville | 210/449 |
| 5,653,252 | A | | 8/1997 | Steg et al. | 137/315 |
| 5,706,982 | A | | 1/1998 | Siddiovi et al. | 222/146.5 |
| 6,363,566 | B1 | | 4/2002 | Collins | 15/104.5 |
| 6,631,588 | B1 | | 10/2003 | Distler | 52/12 |

* cited by examiner

*Primary Examiner*—Kevin L Lee
(74) *Attorney, Agent, or Firm*—John M Harrison

(57) ABSTRACT

Dual valve and tri-valve drain and pipe-cleaning devices which are characterized by a length of pipe having one or two valves such as gate valves and a nipple extending from the pipe and fitted with a third valve for receiving a flush hose or the outlet nozzle of a compressed air cylinder. When the cleaning device is inserted in the drain line beneath a sink or drain system, the valves can be manipulated to flush the drain line, including the main drain line extending from the sink or drain, by the introduction of water under pressure or compressed air, as desired. Clearing of the drain line(s) downstream of the cleaning device is typically effected using the dual valve system, while flushing of the downstream drain line as well as that portion of the drain extending from the sink or drain system area to the device, is achieved using the tri-valve device.

4 Claims, 3 Drawing Sheets

MULTIPLE VALVE DRAIN AND PIPE-CLEANING DEVICE

CROSS-REFERENCE TO RELATED APPLICATIONS

This application claims the benefit of and incorporates by reference prior filed copending U.S. Provisional Application Ser. No. 60/578,921, Filed Jun. 14, 2004.

SUMMARY OF THE INVENTION

This invention relates to a device for clearing drain lines and more particularly, to dual and tri-valve drainpipe-cleaning devices characterized by a length of pipe fitted in the drain line of a sink or drain system and having one or two valves therein, with a nipple projecting from the pipe and having a third valve. The nipple is fitted for coupling to a water flush hose or to the nozzle of a compressed air cylinder to facilitate flushing of the drain line by water or air pressure.

In a first preferred embodiment of the invention a dual valve and drain cleaning device is characterized by a length of pipe fitted with a valve such as a gate valve for mounting in the drain line beneath a sink or drain system and having a nipple extending from the pipe and fitted with a second gate valve for connection to the flush hose or compressed air cylinder. When the gate valve in the pipe is closed and the nipple gate valve opened, water can be introduced from the faucet or an external source into the pipe nipple and the pipe and then through the drain line downstream of the device, for clearing the drain pipe.

In a second preferred embodiment, under circumstances where two gate valves are used in spaced-apart relationship with respect to each other in the cleaning pipe, the nipple extends from the pipe between the two gate valves. Water or air introduced into the nipple with the nipple gate valve open and the gate valve in the pipe located closest to the sink drain closed clears the drain line downstream of the device by opening the second gate valve. Alternatively, the gate valve closest to the sink drain line can be opened and the second pipe gate valve closed, while the gate valve in the nipple is open, to facilitate clearing that segment of the drain line located between the device and the sink.

BRIEF DESCRIPTION OF THE DRAWINGS

The invention will be better understood by reference to the accompanying drawings, wherein:

FIG. 1 is a perspective view of a first preferred dual valve drain and pipe-cleaning device embodiment of the invention, wherein the pipe element is mounted in the drain line extending from a sink and a p-trap (both illustrated in phantom), with a pipe nipple extending downwardly from the pipe and fitted with a valve for accommodating a flush hose or a compressed air bottle or the like;

DESCRIPTION OF THE PREFERRED EMBODIMENTS

Figure 1:
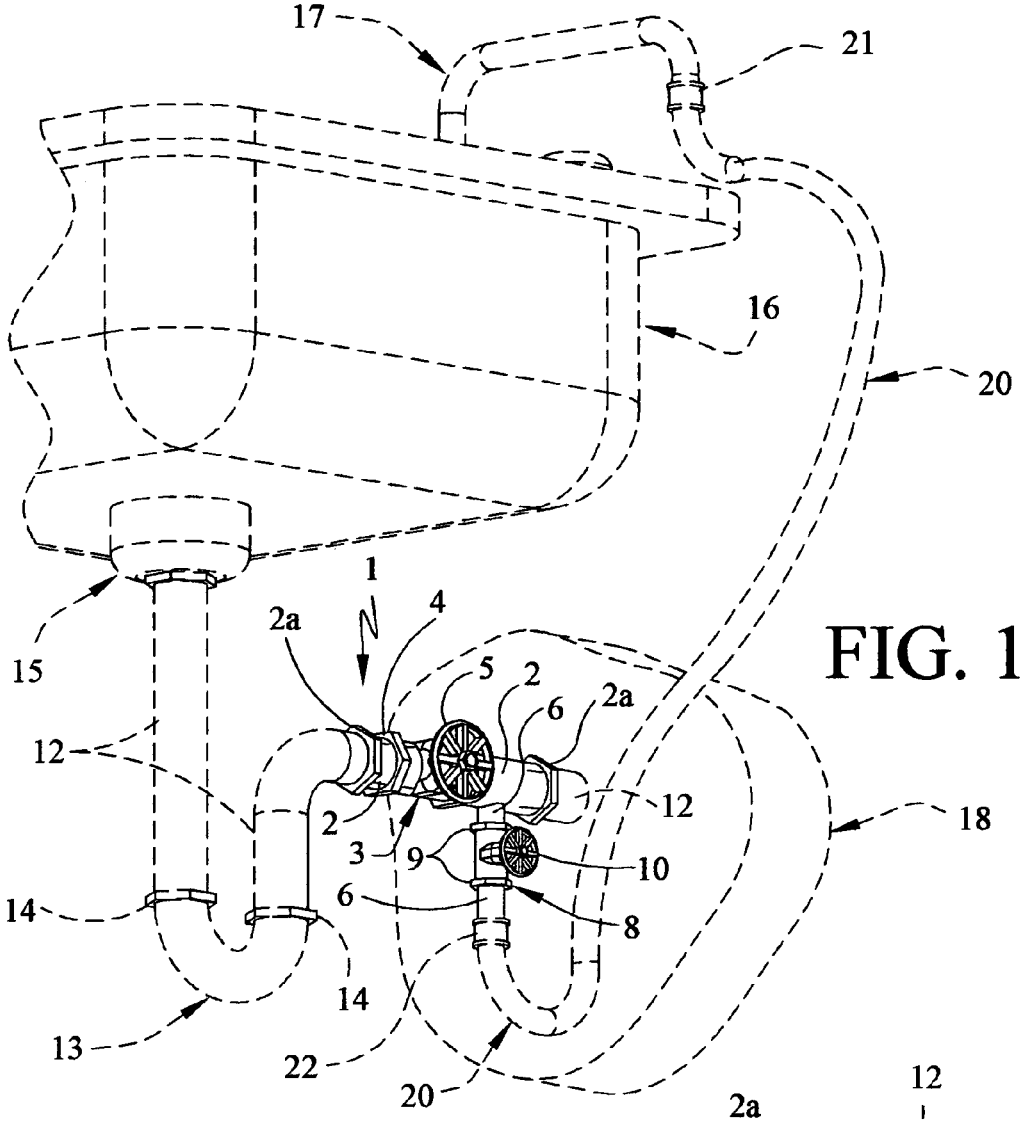
Figure 2:
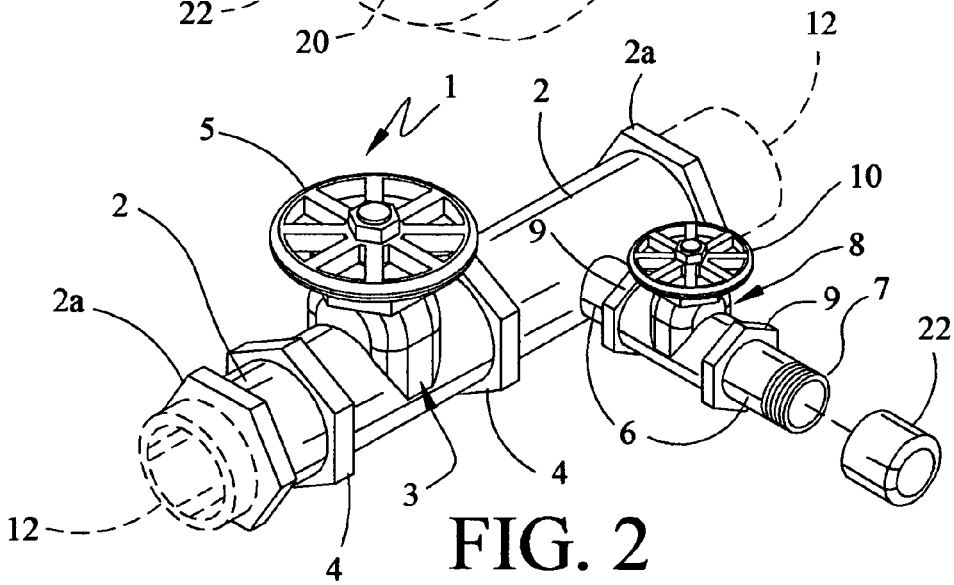
FIG. 2 is a perspective view of the dual valve drain and pipe-cleaning device illustrated in FIG. 1, wherein the pipe nipple is provided with a flush hose nipple coupling for connecting the pipe nipple to a flush hose.

Referring initially to FIGS. 1 and 2 of the drawings in a first preferred embodiment of the invention a dual valve drain and pipe-cleaning device is generally illustrated by reference numeral 1 and includes a length of pipe 2 which may be constructed of plastic, iron, steel or the like, having a pipe valve 3 mounted near one end, as illustrated. The pipe valve 3 typically includes pipe valve flanges 4 and a pipe valve wheel or handle 5 and may be typically characterized as a gate valve. Accordingly, the pipe valve flanges 4 are connected to the pipe 2, typically by threading the ends of the pipe 2 into the corresponding pipe valve flanges 4 or by glue, unions or other couplings known to those skilled in the art. A pipe coupling 2*a* is typically provided on each end of the pipe 2 for attaching the pipe 2 to a drain line 12 (illustrated in phantom) in the same manner. A pipe nipple 6 projects from the pipe 2 and has a pipe nipple valve 8 which may also be characterized by a gate valve, typically having pipe nipple flanges 9, for receiving the respective threaded ends of the pipe nipple 6 and fitted with a pipe nipple valve wheel or handle 10 for opening and closing the pipe nipple valve 8, as desired. A flush hose nipple coupling 22 may be threaded or otherwise provided on the end of the pipe nipple 6 at the pipe nipple threads 7 for attaching the pipe nipple 6 to a flush hose 20, illustrated in phantom in FIG. 1. The opposite end of the flush hose 20 may be typically secured to the spout end of a faucet 17 extending above a sink 16 by means of a flush hose faucet coupling 21 or by any other convenient manner, as further illustrated in FIG. 1.

Accordingly, as illustrated in FIGS. 1 and 2 of the drawings under circumstances where it is desired to flush and clear that portion of the drain line 12 that extends downstream of the dual valve drain and pipe-cleaning device 1, the pipe valve 3 is initially closed by rotating the pipe valve wheel 5 in the clockwise direction as viewed in FIG. 1. One end of the flush hose 20 is then connected to the faucet 17 and the other end to the pipe nipple 6, typically using the corresponding flush hose faucet coupling 21 and flush hose nipple coupling 22, as described above. The pipe nipple valve wheel 10 is then opened by rotating it in the counterclockwise direction as viewed in FIG. 1. Water is then caused to flow through the faucet 17 and the flush hose 20 and through the pipe nipple 6 and the pipe 2, downstream into the drain line 12 to clear the drain line 12 of obstructions. Since the pipe valve 3 is closed, the water cannot back-flush through that portion of the drain line 12 located between the pipe valve 3 and the sink drain coupling 15.

Figure 3:
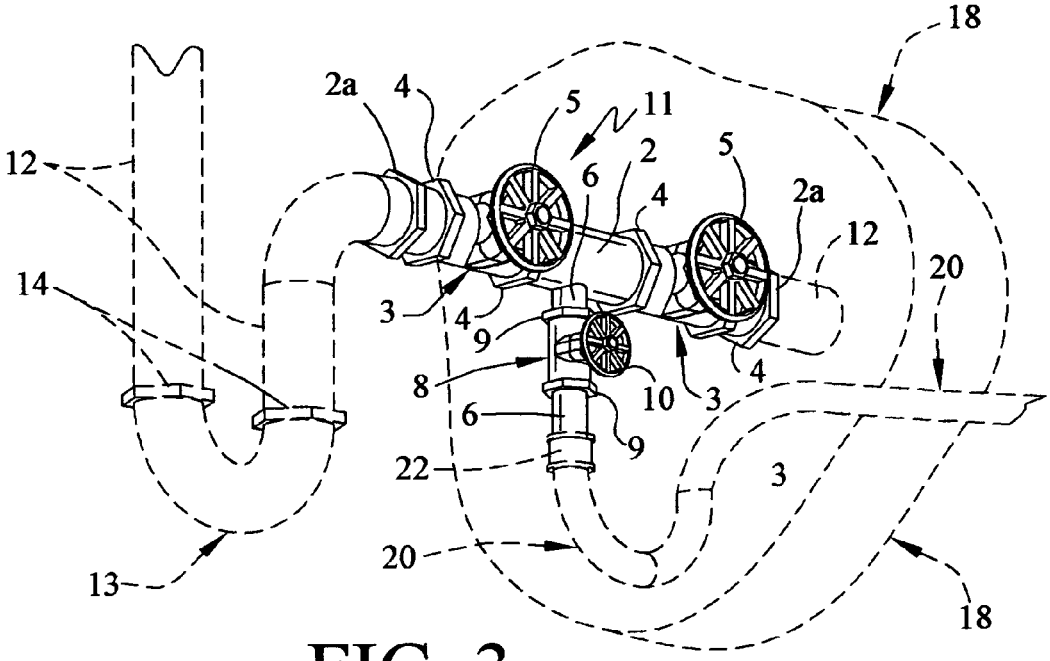
FIG. 3 is a perspective view of a tri-valve drain and pipe-cleaning device embodiment of the invention, wherein a pair of gate valves are provided in spaced-apart relationship with respect to each other in a pipe mounted in the drain system, with the pipe nipple extending from the pipe between the two gate valves and fitted with a third gate valve and wherein the pipe nipple is connected to a flush hose.
Figure 4:
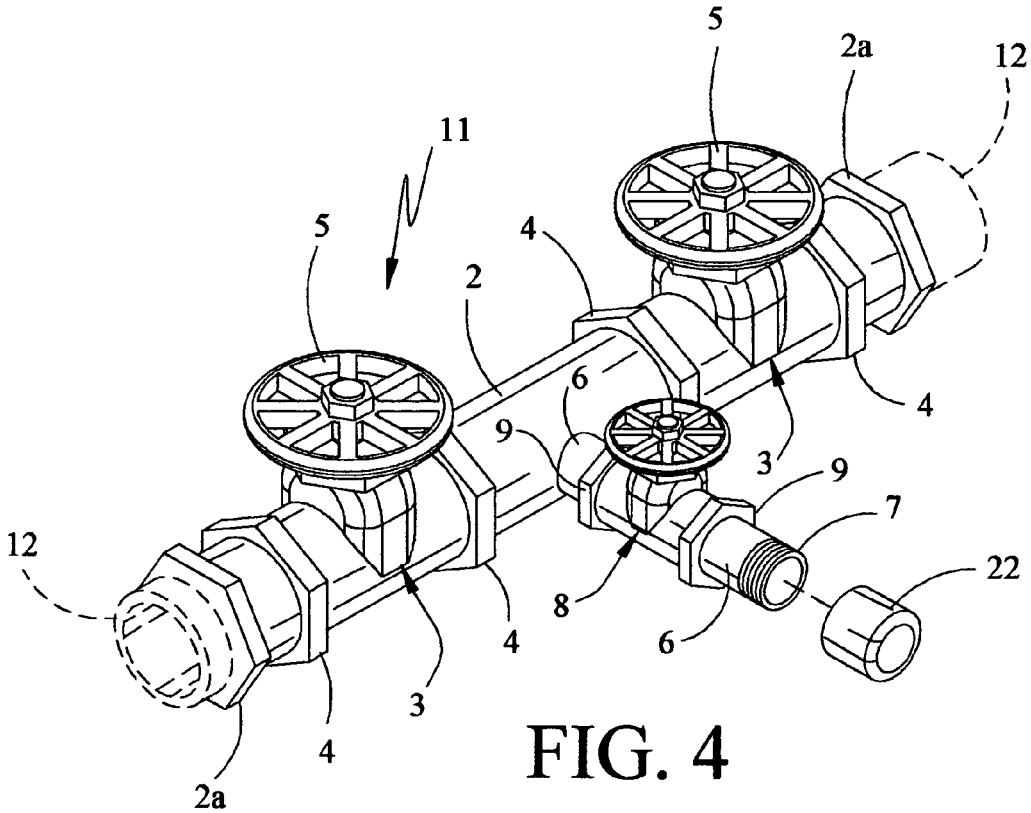
FIG. 4 is a perspective view of the tri-valve drain and pipe-cleaning device illustrated in FIG. 3, more particularly illustrating a flush hose nipple coupling or connector provided on the end of the pipe nipple for connecting the pipe nipple to the flush hose illustrated in FIG. 3.

Referring now to FIGS. 3 and 4 of the drawings in another preferred embodiment of the invention a tri-valve drain and pipe-cleaning device 11 is installed in the drain line 12, such that either of the pipe valves 3 can be opened or closed, along with the pipe nipple valve 8 located in the pipe nipple 6. Accordingly, under circumstances where it is desired to clear that portion of the drain 12 located downstream of the pipe 2, the flush hose 20 is installed on the pipe nipple 6 and attached to the faucet 17 using the corresponding flush hose nipple coupling 22 and flush hose faucet coupling 21, respectively, as described above with respect to FIG. 1 of the drawings. The pipe nipple valve 8 is then opened, the left-hand pipe valve 3 closed and the right-hand pipe valve 3 opened, to facilitate a flow of water through the flush hose 20, the pipe nipple 6 and the pipe 2, into the drain line 12 extending through the wall 18 (FIG. 3), to clear the drain line obstruction.

Under circumstances where it is desired to flush that portion of the drain line 12 and the p-trap 13 extending upstream of the pipe 2, the left-hand pipe valve 3 is opened by rotating the corresponding pipe valve wheel 5 in the counterclockwise direction, while the right-hand pipe valve 3 is closed by rotating the corresponding pipe valve wheel 5 in the clockwise direction, as viewed in FIG. 3. Opening of the pipe nipple valve wheel 10 of the pipe nipple valve 8 then facilitates a flow of water through the flush hose 20 by initiating a flow of water through the faucet 17 illustrated in FIG. 1, such that water flows through the pipe nipple 6 and the left-hand portion of the pipe 2 and through the drain line 12, as well as the p-trap 13, to clear the upper portion of the drain line 12.

Figure 5:
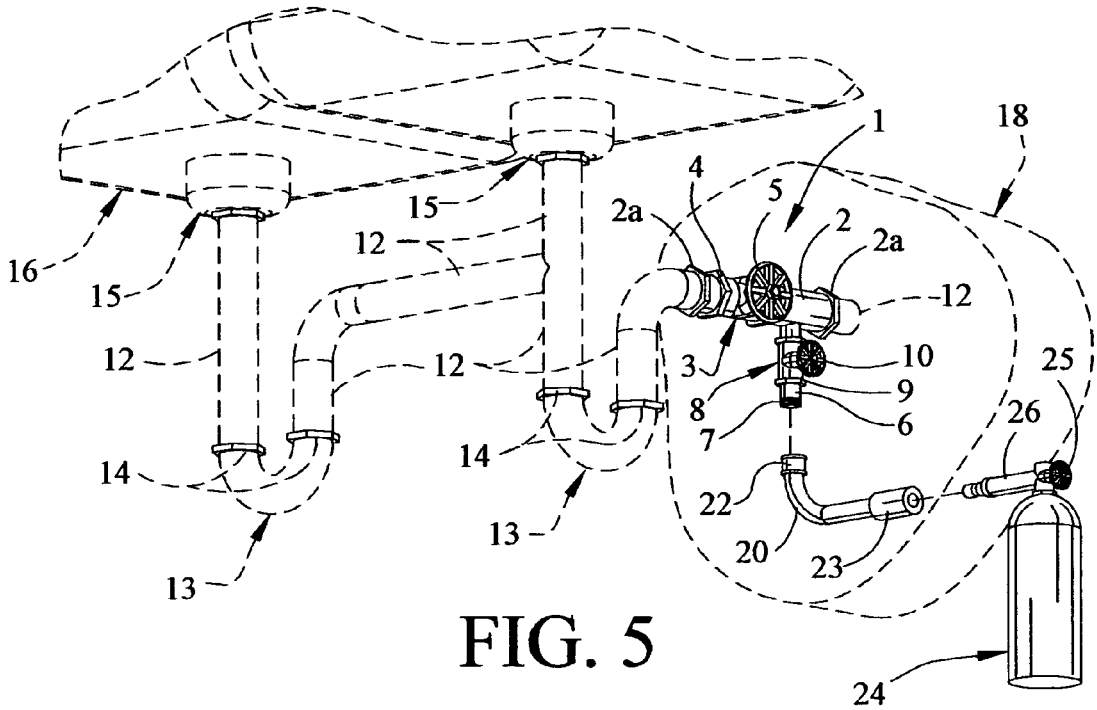
FIG. 5 is a perspective view of the dual valve drain and pipe-cleaning device illustrated in FIGS. 1 and 2 mounted in a drain line system extending beneath a pair of sinks and including a pair of p-traps, wherein the pipe nipple element is connected to the cylinder nozzle of a compressed air cylinder for clearing the drain line system.

Referring to FIG. 5 of the drawings in another preferred embodiment of the invention the dual drain and pipe-cleaning device 1 illustrated in FIGS. 1 and 2 is installed in a drain line 12 which serves a pair of sinks 16 (illustrated in phantom) and includes a pair of corresponding p-traps 13. In this embodiment the pipe nipple 6 is fitted with a short flush hose 20, typically having a flush hose nipple coupling 22 as heretofore described with respect to the longer flush hose 20 embodiments illustrated in FIGS. 1-4 of the drawings. The opposite end of the flush hose 20 is provided with a flush hose nozzle fitting 23 which is compatible with the corresponding extending end of the cylinder nozzle 26 of a compressed air cylinder 24 having a cylinder valve 25, as further illustrated in FIG. 5 of the drawings. Accordingly, when the cylinder valve 25 is opened by rotation in the counterclockwise direction as viewed in FIG. 5, compressed air is allowed to escape from the compressed air cylinder 24 and flow through the cylinder nozzle 26, the flush hose 20 and the pipe nipple 6 and then through the right-hand portion of the pipe 2, since the pipe valve 3 is closed, as heretofore described. Compressed air from the compressed air cylinder 24 thus operates to clean and clear the drain line 12 downstream from the dual valve drain and pipe-cleaning device 1 of obstruction.

It will be appreciated from a consideration of FIG. 5 and FIGS. 3 and 4 of the drawings that the tri-valve drain and pipe-cleaning device 11 may alternatively be installed in the drain line 12 illustrated in FIG. 5, thus facilitating use of compressed air from the compressed air cylinder 24 to clear that portion of the drain line 12 which extends upstream of the left-hand pipe valve 3, including both of the p-traps 13 and the sink drain couplings 15 of the respective sinks 16, as heretofore described with respect to FIGS. 3 and 4 of the drawings.

Figure 6:
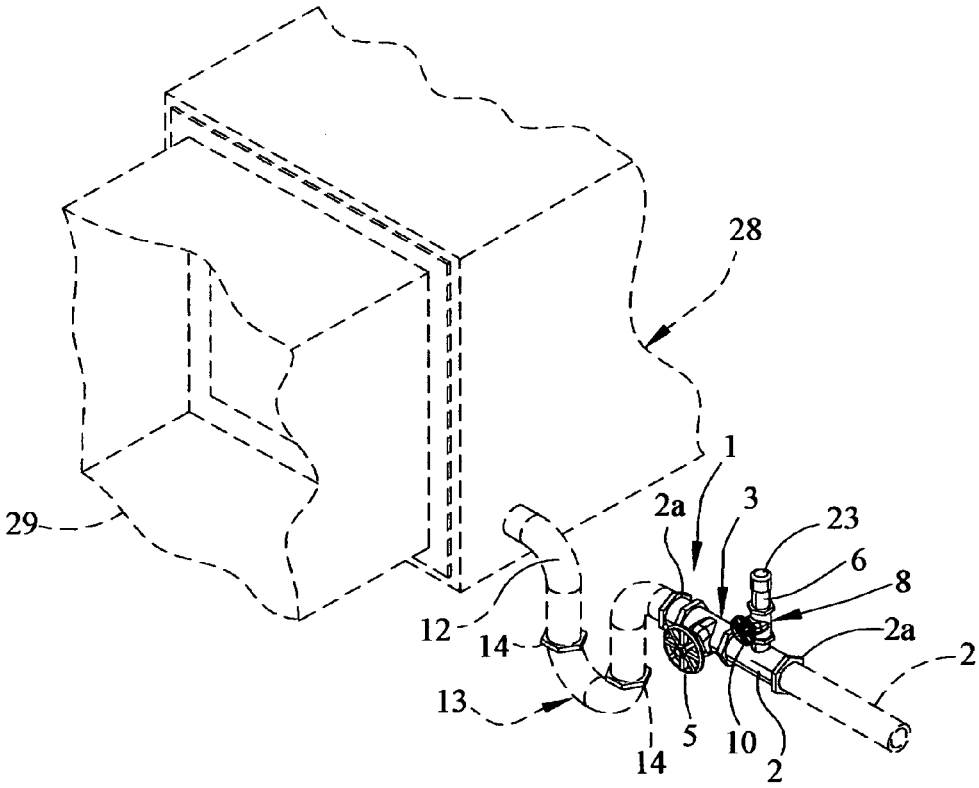
FIG. 6 is a perspective view of the dual drain and pipe-cleaning device illustrated in FIGS. 1, 2 and 5 mounted in a drain line of an air conditioning system, with the pipe nipple extending upwardly for attachment to a flush hose or to a compressed air cylinder and clearing the air conditioning drain line.

Referring now to FIG. 6 of the drawings in another preferred embodiment of the invention the dual valve drain and pipe-cleaning device 1 may be installed in the drain line 12 projecting from an air conditioning plenum 28, fitted with a duct 29 for transporting air through an air conditioning system of a structure (not illustrated). The drain line 12 may optionally be fitted with a p-trap 13 and the pipe nipple 6 extending upwardly from the pipe 2 of the dual valve drain and pipe fitting device 1 is provided with a pipe nipple valve 8. An appropriate fitting such as the flush hose nozzle fitting 23 illustrated in FIG. 5, may be attached to the flush hose 20 to facilitate clearing of the drain line 12 by use of the compressed air cylinder 24, as heretofore described with respect to FIG. 5 of the drawings. In like manner, the tri-valve drain and pipe-cleaning device 11 may be installed in place of the dual valve drain and pipe-cleaning device 1 illustrated in FIG. 6, to provide the facility for clearing that portion of the drain 12 extending between the left-hand pipe valve 3 and the air conditioning plenum 28, as well as that portion of the drain line 12 projecting downstream of the right-hand pipe valve 3, according to the procedure described above with respect to FIGS. 3 and 4 of the drawings.

It will be appreciated by those skilled in the art that installation and use of both the dual valve drain and pipe-cleaning device 1 and the tri-valve drain and pipe-cleaning device 11 of this invention are characterized by ease and convenience, in that both devices can be constructed of metal, plastic or any other desired material and installed in substantially any drain line, whether it be a plastic or metal drain line, beneath a sink or sinks or in the drain systems of any drain complex. Furthermore, the capacity for clearing both that portion of the drain downstream and upstream of the installed device can be provided in the tri-valve drain and pipe-cleaning device 11, whereas the facility for clearing only that portion of the drain 12 extending downstream of the device may be facilitated using the dual valve drain and pipe-cleaning device 1 illustrated in FIGS. 1, 2, 5 and 6 of the drawings.

While the preferred embodiments of the invention have been described above, it will be recognized and understood that various modifications may be made in the invention and the appended claims are intended to cover all such modifications which may fall within the spirit and scope of the invention.

What is claimed is:

1. A drain and pipe-cleaning device for cleaning a drain pipe, comprising a pipe of selected length for mounting in the drain pipe; a pair of pipe valves disposed in spaced-apart relationship with respect to each other in said pipe; a pipe nipple extending from said pipe intermediate said pipe valves; and a pipe nipple valve provided in said pipe nipple, wherein obstructions in the drain pipe are cleared responsive to selective opening and closing of said pipe, valves, opening said pipe nipple valve and introducing a fluid into said pipe nipple, said pipe and the drain pipe.

2. The drain and pipe-cleaning device of claim 1 wherein said pipe valves are gate valves.

3. The drain and pipe-cleaning device of claim 1 wherein said pipe nipple valve is a gate valve.

4. The dual-valve drain and pipe-cleaning device of claim 1 wherein said pipe valves are gate valves and said pipe nipple valve is a gate valve.

* * * * *